US005527120A

United States Patent [19]

Helinski

[11] Patent Number: 5,527,120

[45] Date of Patent: Jun. 18, 1996

[54] RIBBON SHIELD FOR IMPACT LINE PRINTERS

[75] Inventor: Edward F. Helinski, Johnson City, N.Y.

[73] Assignee: IBM Corporation, Armonk, N.Y.

[21] Appl. No.: 156,652

[22] Filed: Nov. 22, 1993

Related U.S. Application Data

[63] Continuation of Ser. No. 921,150, Jul. 29, 1992, abandoned.

[51] Int. Cl.[6] ..... B41J 35/26

[52] U.S. Cl. ..... 400/247; 400/248

[58] Field of Search ..... 400/247, 248

[56] References Cited

U.S. PATENT DOCUMENTS

| | | | |
|---|---|---|---|
| 4,165,188 | 8/1979 | Rempel | 400/248 |
| 4,437,401 | 3/1984 | Heinrich et al. | 400/248 |

FOREIGN PATENT DOCUMENTS

| | | | |
|---|---|---|---|
| 0055776 | 3/1984 | Japan | 400/248 |
| 0099690 | 6/1985 | Japan | 400/248 |
| 0005977 | 1/1986 | Japan | 400/247 |

OTHER PUBLICATIONS

"Ribbon Shield" IBM Technical Disclosure Bulletin vol. 28, No. 10, Mar. 1986.

Bonafino et al. "Ribbon Retainer" IBM Technical Disclosure Bulletin, vol. 19, No. 2, Jul., 1976.

*Primary Examiner*—Edgar S. Burr
*Assistant Examiner*—Anthony H. Nguyen
*Attorney, Agent, or Firm*—Michael E. Belk; Saul A. Seinberg

[57] ABSTRACT

A ribbon shield for an impact printer having a row of print hammers and an endless moving type band comprises an elastic separator sheet in which an edge thereof is formed with an offset projecting from the plane of the sheet. The offset projects an amount which is greater than the thickness of the sheet. The sheet, which is made preferably from a polyester material, can be very thin so that it will not cause underscoring and its compliance to force from the print hammer will not extract the energy therefrom.

9 Claims, 3 Drawing Sheets

RIBBON SHIELD FOR IMPACT LINE PRINTERS

The application is a continuation, of application Ser. No. 07/921,150, filed Jul. 29, 1992, now abandoned.

FIELD OF THE INVENTION

This invention relates to printing and particularly to a ribbon shield device for use in impact line printers.

BACKGROUND OF THE INVENTION

High speed impact line printers comprise an endless type band with a row of characters moving parallel with a row of print hammers. The band is trained on spaced drive and idler or tension pulleys which are motor driven to revolve the band at constant speed. The hammers and type band are separated by a narrow gap or passageway through which a continuous web which is moved intermittently and an ink ribbon which is constantly in motion relative to the paper. Electronic controls operate the print hammers individually in synchronism with the moving type band to impact the paper and ink ribbon against each other and selected characters on the moving band. It is common practice to provide a separator device, also called a ribbon shield, which operates to maintain the paper and ink ribbon separated except when the hammer impacts the paper against the ribbon and characters. The purpose of the shield is to reduce smudge and ink transfer between ribbon and paper primarily during non-printing intervals. Smudge is usually worse on multi-part forms. It is desirable to have a thick shield to obtain maximum separation to reduce smudge. However, thick shields, in addition to absorbing greater energy from the print hammers, cause underscore on multi-part forms. This underscore is due to the pressure and force of the ribbon shield during impact by the hammers.

Such ribbon shield devices can take various forms. In the case of U.S. Pat. No. 4,437,401, the ribbon shield comprises a separator plate made of plastic foil which is configured in the form of a flattened Z, one section of which is attached to the printer frame and the other section of which presses the paper against the print hammer plate at some position below but near and coextensive with the print line. Another form of ribbon shield comprises a frame member and a elastic shield element attached thereto. The shield element may have a window through which the paper is driven by the hammer against the ribbon and type. Unless the ribbon is maintained taut, a problem with the window shield is snagging of the loose ribbon on the edges of the window. In another form of shield, the shield element is a flat plastic separator sheet attached to a U-shaped frame. The edge of the separator sheet extends across the width of the paper. As in the case of the flat Z separator plate, the plastic sheet needs to be relatively thick to provide adequate separation force but presents the problem of underscoring. The problem of underscoring can be reduced by lowering the edge further below the print line but this reduces the separation in the print zone during non-printing which increases the chances for smudging.

SUMMARY OF THE INVENTION

The invention overcomes the problems of prior ribbon shields used in impact printers by providing an elastic separator sheet in which an edge thereof is formed with an offset projecting from the plane of the sheet. The offset projects an amount which is greater than the thickness of the sheet. The sheet, which is made preferably from a polyester material, can be very thin so that it will not cause underscoring and its compliance to force from the print hammer will not extract the energy therefrom.

The above and other advantages will be readily apparent from the detailed description of the invention as illustrated in the following drawings.

DETAILED DESCRIPTION OF THE INVENTION

Figure 1:
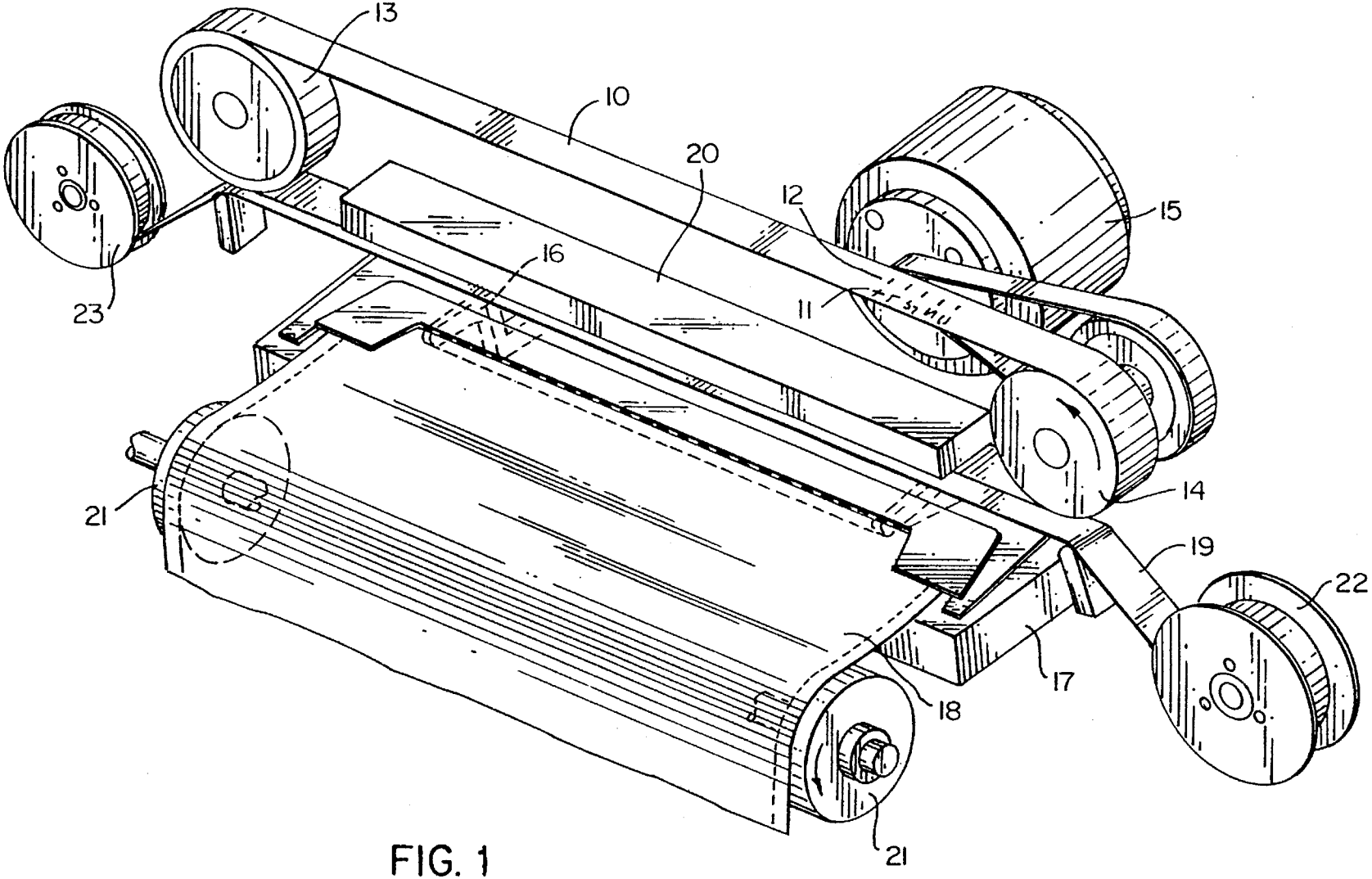
FIG. 1 is a perspective view of a type band printer in which the invention is employed.

As seen in the figures, an impact line printer includes an endless type band 10 with a row of type elements 11 parallel with a row of timing marks 12 on the outer surface thereof. Band 10 is revolved by pulleys 13 and 14 connected to a drive motor 15 past a row of print hammers 16 mounted on base plate 17. Paper 18 and ink ribbon 19 are moved through a gap formed between the print hammers 16 and type band 10. Platen 20 which is located between pulleys 13 and 14 provides backup to the type band 10 in opposition to impacts of paper 18 and ink ribbon 19 against type elements 11 caused by operation of print hammers 16. As is well known, paper 18 is a perforated single layer or multiple layered continuous web advanced in a direction transverse to the row of print hammers 16 by automatically controlled feed devices such as pin wheels 21. Also well known, ink ribbon 19 is fed between the paper 18 and type band 10 in either one or two directions parallel with the row of print hammers 16 by spools 22 and 23 connected to automatically controlled drive motors (not shown). A ribbon shield 24 incorporating the features of the invention is removably attached at points 25 to base plate 17. A particular print apparatus in which the invention has application is described in greater detail in U.S. Pat. No. 5,108,205 and copending application Ser. No 07/845,403 filed Mar. 3, 1992.

Figure 2:
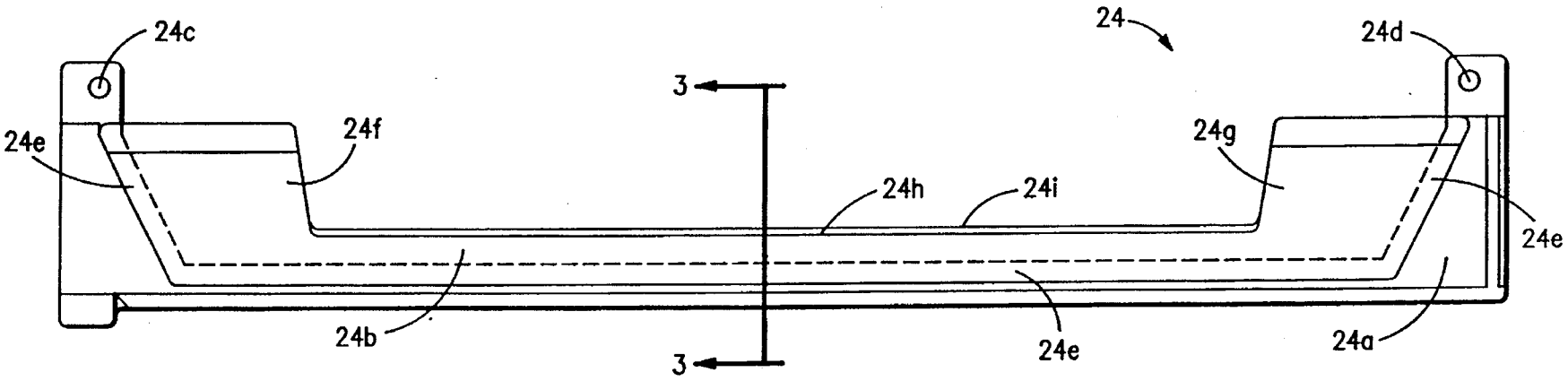
FIG. 2 is a plan view of a ribbon shield device used in FIG. 1.
Figure 3:
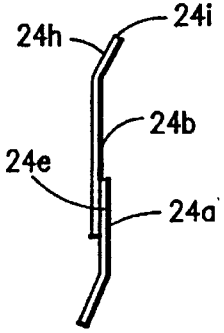
FIG. 3 is a cross section of the ribbon shield taken along lines 3—3 of FIG. 2.

As seen more clearly in FIGS. 2 and 3, ribbon shield 24 comprises U-shaped support plate **24*a* and elastic separator sheet 24*b* attached thereto. Support plate 24*a* has attachment holes 24*c* and 24*d* for receiving screws or other suitable means whereby ribbon shield 24 may be attached to base plate 16 at points 25 as seen in FIG. 1. Sheet 24*b* is preferably also U-shaped and is bonded to support plate 24*a* by an adhesive tape 24*e* or the like extending across the bottom edge and up the outer edges of side arms 24*f* and 24*g* of sheet 24*b*. In accordance with this invention, separator sheet 24*b* has offset 24*h* between side arms 24*f* and 24*g* which terminates in a straight edge 24*i*. The length of offset 24*h* and straight edge 24*i* is sufficient to span the row of print hammers 16. As shown in FIG. 3, offset 24*h* is preferably curved and projects from the plane of sheet 24*a* for a distance greater than the thickness of sheet 24*a*. By having offset 24*h*, separator sheet 24*b* can be made very thin so that it is compliant to pressure applied by print hammers 16 yet at the same time is capable of producing a separation of paper 18 and ink ribbon 19** which was previously obtainable by the use of a much thicker piece of elastic material.

Because of its compliance, offset 24*h* can be positioned much more closely to the print line without risk of causing underscore on paper 18.

A suitable material for separator sheet 24*b* is preferably a thin foil of synthetic material, for example a polyester such as Mylar made by dupont. The thickness of sheet 24*b* is between 0.10 and 0.14 mm. The distance offset 24*h* projects outside the plane of sheet 24*b* is between 0.2 and 0.5 mm. Offset 24*h* can be formed in different ways in order to project outside the plane of sheet 24*b* but preferably is formed by a thermoforming process whereby the edge of sheet 24*b* is bent to have a curved cross section.

Figure 4:
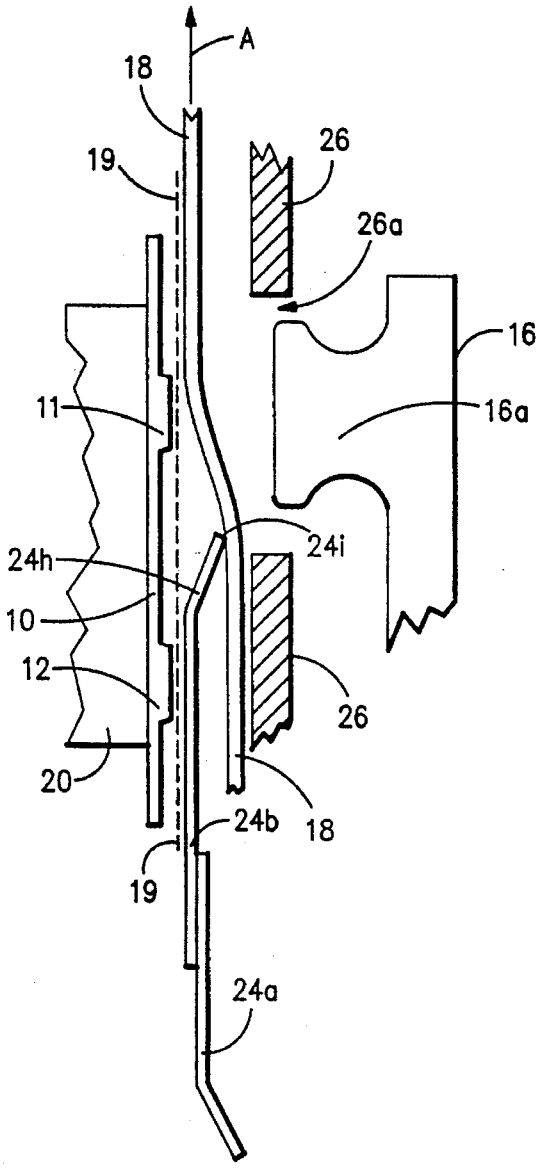
FIGS. 4 and 5 are schematic drawings illustrating the operation of ribbon shield device in the printer of FIG. 1.
Figure 5:
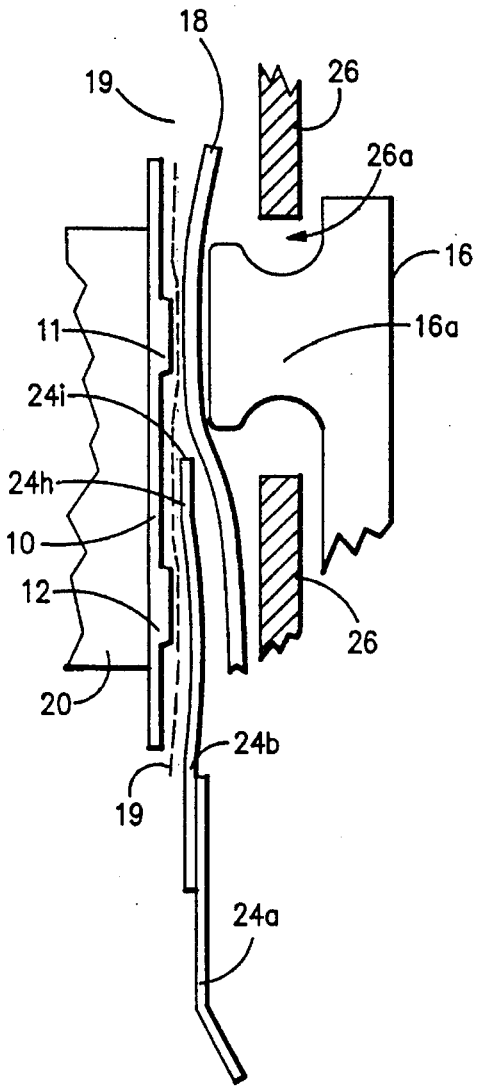

The operation of the separator sheet 24*b* is more easily understood by referring to FIGS. 4 and 5. As seen in FIG. 4, paper 18 and ink ribbon 19 move in the gap between hammer plate 26, which is part of the assembly unit for hammers 16 mounted on base plate 17, and band 10. Paper 18 moves upwardly as indicated by direction arrow A in a direction transverse to the row or print hammers 16. Ink ribbon 19 moves perpendicular to the plane of the drawing. As previously mentioned, paper 18 is moved intermittently whereas ink ribbon 19 is constantly moving. Thus, unless ribbon 19 and paper 18 are separated, smudging can occur which affects the quality of the printing on paper 18. An aperture 26*a* in plate 26 permits the heads 16*a* of hammers 16 to operate in the direction of type band 10. Separator sheet 24*b* supported by U-shaped support plate 24*a*, protrudes, in the region of the opening between side arms 24*f* and 24*g*, between paper 18 and ink ribbon 19. As shown, the offset 24*h* with straight edge 24*i* projects outwardly from the plane of sheet 24*b* toward paper 18 by an amount greater than the thickness of sheet 24*b*. Thus paper 18 and ink ribbon 19 are separated by a distance which can be substantially greater than the thickness of the separator sheet 24*b*. It can also be seen that the straight edge 24*i* can be located quite close to the bottom edge of hammer heads 16*a*. As seen in FIG. 5, hammer head 16*a* of hammers 16 have impacted paper 18 against type element 11 of band 10. Offset 24*h* of separator sheet 24*b*, due to its compliance, has been deflected toward type band 10 by the force of hammer head 16*a*. In fact, sheet 24*b* is also deflected which due the thinness thereof absorbs relatively little energy from hammers 16.

While the invention has been shown and described with reference to a particular embodiment thereof, it will be understood by those skilled in the art that various changes in form and detail may be made therein without departing from the spirit and scope of the invention.

What is claimed is:

1. In a printer apparatus having a print mechanism comprising a row of print hammers and an endless moving type carrier with a row of type elements having a portion extending parallel with said print hammers with a gap therebetween for the passage of paper and ink ribbon therethrough in overlapping relationship, and means for maintaining said paper separated from said ink ribbon when passing through said gap except when impacted by said print hammers against said type elements comprising:

means for positioning both the ink ribbon and the paper to separate the paper from the ink ribbon further than the thickness of the separator sheet and for locally flattening when one of said print hammers strikes said paper to allow the paper to strike the ink ribbon said means for positioning including a flat elastic separator sheet having compliant offset means projecting outside the plane of said elastic sheet in the direction of said paper and terminating in a straight edge extending across the width of said print hammers near the print hammers and positioned entirely between said paper and said ink ribbon, and a support plate extending to an edge across the width of the print hammers near the print hammers for supporting said elastic separator sheet.

2. In a printer apparatus in accordance with claim 1 in which said offset has a curved cross section.

3. In a printer apparatus in accordance with claim 1 in which said projection of said offset from the plane of said elastic sheet is locally reduced by more than ½ when one of said hammers strike.

4. In a printer apparatus in accordance with claim 1 in which said elastic sheet is a made from a polyester material and said offset is formed by thermoforming an edge of said sheet.

5. In a printer apparatus in accordance with claim 1 in which said elastic sheet has a thickness in the range of 0.1 mm to 0.15 mm and the distance said offset projects from the plane of said sheet is in the range of 0.2 mm to 0.5 mm.

6. A ribbon shield device for separating paper and ink ribbon in an impact printer comprising in combination a U-shaped support plate having an opening, and a flat elastic separator sheet attached thereto, said sheet having an offset terminating in a straight edge that extends across the opening of said support plate, said offset and said straight edge projecting beyond the plane of said sheet, and means on said support plate for mounting said ribbon shield device in and impact printer with said straight edge and said offset located entirely between the paper and ink ribbon.

7. A ribbon shield device in accordance with claim 6 in which, said offset projects from the plane of said elastic sheet at an angle less than 90 degrees and by an amount which is greater than the thickness of said separator sheet.

8. A ribbon shield device in accordance with claim 6 in which said elastic sheet is made from a polyester material and said offset is formed by thermoforming an edge of said sheet.

9. A ribbon shield device in accordance with claim 6 in which said elastic sheet has a thickness in the range of 0.1 mm to 0.15 mm and the distance said offset projects from the plane of said sheet is in the range of 0.2 mm to 0.5 mm.

* * * * *